US008360239B2

(12) United States Patent
Kroell

(10) Patent No.: US 8,360,239 B2
(45) Date of Patent: Jan. 29, 2013

(54) KIT FOR TRANSFERRING AN IMAGE ONTO AN OBJECT

(76) Inventor: Keith B. Kroell, Tyler, TX (US)

( * ) Notice: Subject to any disclaimer, the term of this patent is extended or adjusted under 35 U.S.C. 154(b) by 241 days.

(21) Appl. No.: 13/027,915

(22) Filed: Feb. 15, 2011

(65) Prior Publication Data

US 2011/0265953 A1 Nov. 3, 2011

Related U.S. Application Data

(60) Provisional application No. 61/304,529, filed on Feb. 15, 2010.

(51) Int. Cl.
*B65D 71/00* (2006.01)

(52) U.S. Cl. ..... 206/575; 206/223

(58) Field of Classification Search ..... 206/575, 206/223, 578, 224, 229
See application file for complete search history.

(56) References Cited

U.S. PATENT DOCUMENTS 2,720,964 A * 10/1955 Hopper ..... 206/223
3,760,724 A 9/1973 Budzinski et al.
4,010,057 A 3/1977 Nakanishi
4,231,829 A 11/1980 Marui et al.
4,269,650 A 5/1981 Arai et al.
4,436,571 A 3/1984 Nakanishi
4,471,873 A * 9/1984 Thomas ..... 206/573
4,479,432 A 10/1984 Masaki et al.
4,584,042 A * 4/1986 Wandroik ..... 156/280
4,722,853 A 2/1988 Batliwalla et al.
5,266,141 A 11/1993 Seailles et al.
5,270,087 A * 12/1993 Polsky ..... 428/38
5,501,602 A * 3/1996 Anderson et al. ..... 434/263
5,695,587 A 12/1997 Dumoux
5,833,649 A * 11/1998 Atef ..... 604/500
5,908,525 A 6/1999 Zaher
6,022,438 A 2/2000 Watanabe et al.
6,322,654 B1 11/2001 Walter et al.
6,437,023 B1 8/2002 Otaki et al.
6,497,779 B1 12/2002 Suzuki et al.
6,551,392 B1 4/2003 Otaki et al.

(Continued)

FOREIGN PATENT DOCUMENTS

EP 0 913 439 A1 6/1999
EP 0 913 440 A1 6/1999

(Continued)

*Primary Examiner* — David Fidei
(74) *Attorney, Agent, or Firm* — Shlesinger Arkwright & Garvey LLP

(57) ABSTRACT

The present invention is a personal water transfer imaging process kit for application of an image to an object. A pre-printed film having an image thereon is suspended within a vat of water to hydrate the ink after which it is activated. The object is submerged into the vat containing the hydrated and activated ink to generate pressure against the object and cause transfer the ink image onto the object. Primer, base coat, top coat, activator, film and supporting supplies are all supplied within the self-contained kit. The primer coating material, base coating material, activator material and top coat material are the form of a hand held aerosol propellant or pump actuator devices. The kit components are efficiently packaged within a cardboard tube provided with protective clear outer skin. The sensitive image transfer film and supporting components are thereby protected from moisture, dirt and damage while in the tube. The compact size makes the kit retail and retailer friendly and less costly to ship and occupies less retail when displayed in a retail outlet.

14 Claims, 8 Drawing Sheets

U.S. PATENT DOCUMENTS

| | | | | |
|---|---|---|---|---|
| 6,554,940 | B2 | 4/2003 | Otaki et al. | |
| 6,578,710 | B1 * | 6/2003 | Brown et al. | 206/457 |
| 6,599,579 | B1 | 7/2003 | Kiyotaki | |
| 6,852,394 | B2 | 2/2005 | Otaki et al. | |
| 6,939,585 | B1 | 9/2005 | Mizuta | |
| 2007/0205118 | A1 * | 9/2007 | Westendorf et al. | 206/229 |
| 2010/0264057 | A1 * | 10/2010 | McClarnan | 206/575 |
| 2012/0187022 | A1 * | 7/2012 | Ostroff et al. | 206/575 |

FOREIGN PATENT DOCUMENTS

| | | |
|---|---|---|
| JP | 8-238897 | 6/1996 |
| JP | 10-035195 | 2/1998 |
| JP | 10-035196 | 3/2001 |

* cited by examiner

FIG. 18
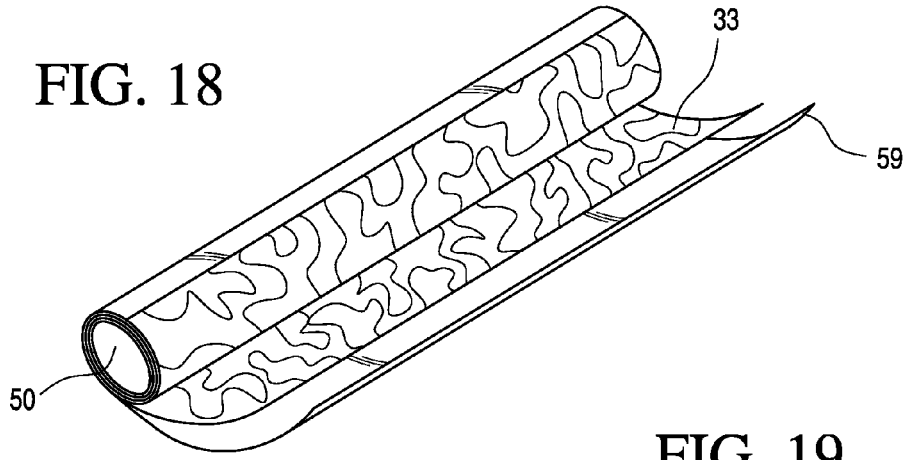
FIG. 19
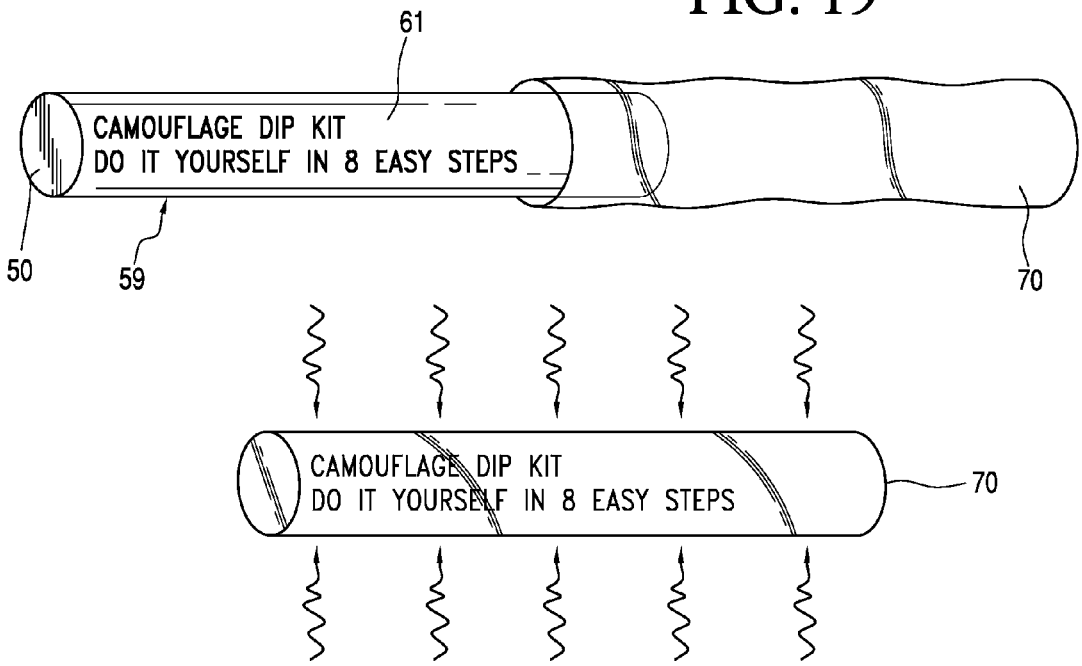
FIG. 20
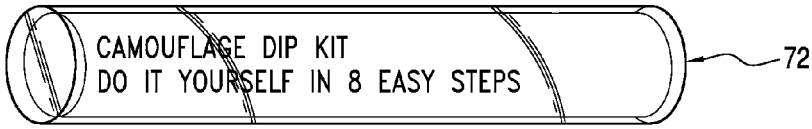
FIG. 21

KIT FOR TRANSFERRING AN IMAGE ONTO AN OBJECT

CROSS-REFERENCE TO RELATED APPLICATION

This application is a non-provisional claiming the benefit of provisional application Ser. No. 61/304,529, filed on Feb. 15, 2010, which is incorporated by reference.

FIELD OF THE INVENTION

The present invention relates to transferring images in the nature of a film onto objects or parts.

BACKGROUND OF THE INVENTION

Consumer objects come in a variety of design and colors. An owner may wish to change the overall look of an object.

For example, hunting equipment, such as gunstocks, binoculars, range finders, etc. typically are manufactured in one color such as black. The owner may wish to change the appearance of the object, such as by applying a camouflage pattern thereto. Current avenues for applying images to objects utilize water transfer printing processes. In a water transfer printing process, the image is ink that initially is on the surface of water. The object is then dipped into the water and the ink image coats and etches into the surfaces on the object. This is an expensive process as it is performed using costly equipment in a controlled environment (e.g. temperature, humidity).

Typically, the object must be taken or shipped to a facility that performs the transfer process, adding to the cost and the time required. The process of image transfer from pigmented inks on film suspended in liquid has always been a complicated environmentally controlled process, permitting this process to only be performed commercially with selected individuals and supporting equipment. The development of the present invention allows a retail consumer to perform a similar process within a non-controlled environment and limiting the need for technical support and equipment.

Besides hunting equipment, other objects that are suitable for transferring images include sporting goods, automotive parts, household goods, electronic goods, etc.

It is an object of the present invention to provide a self contained kit that allows an owner or user to perform the image transfer process without the need for costly equipment or a controlled environment or to purchase additional tools or materials to water transfer an image onto an object.

BRIEF SUMMARY OF THE INVENTION

A kit that allows any retail consumer to successfully apply any image on any desired object including, but not limited to, plastic, metal and hardwood materials. The invention is also a method of suspending a pigmented ink image on a liquid, submersing an object into the suspended ink image and then transferring the image to the object by using components of a pre-packaged kit. The kit invention allows a user to ink transfer any object, regardless of shape, taking a heretofore highly technical process and redeveloping the process within kit form so that a retail consumer my perform it at home.

The present invention is a personal water transfer imaging process kit for application of an image to an object by suspending a pre-printed film within a vat of water to hydrate the ink followed by activation of the ink. The object is then submerged into the vat of water containing the hydrated and activated ink to create pressure against the object and transfer the ink image onto the object. Primer, base coat, top coat, activator, film and supporting supplies are all provided within the kit. Primer coating material and base coating material are provided in the form of a hand held aerosol propellant or pump actuator device to assure proper image transfer. Activator coating material is provided within an aerosol propellant or pump actuator device and applied to the film to create a soluble but suspended image on the surface of the liquid. Top coat coating material in an aerosol propellant or pump actuator device is then applied to enhance and to protect the image following transfer to the object. The kit components are packaged within a thick cardboard tube having a protective clear tube outer skin. The film and supporting components are thereby protected from moisture, dirt and damage while in the tube. The compact size makes the kit retail and retailer friendly and less costly to ship by courier to consumers and also consumes less retail space when displayed in a retail outlet.

The kit contains the following components:

1. Primer paint, consisting of solvent or water base chemical that will be applied to the object by using either an aerosol propellant or a pump actuated device. The primer is typically an acrylic material but enamels, lacquers, urethanes, 2-k or other water based compositions are within the scope of the present invention. The primer is coated on the object and allowed to dry so that it forms a surface coating that enables the image to be chemically bonded to the object.

2. Base coat, consisting of a solvent or water base chemical that is applied to a substrate over the dried primer, using either an aerosol propellant or pump actuator device. Preferred base coast is an acrylic material, however enamels, lacquers, urethanes, 2-k or other water based base coat compositions are within the scope of the present invention. The base coat determines the hue or background color to the typically transparent or translucent ink film to be transferred. The base coat material can and does consist of any and all colors within the color spectrum.

3. Top coat, consisting of a protective clear coat applied to the transferred image by an aerosol propellant or pump actuator device. The top coat can be any of a variety of clear coat protective materials including, but not limited to acrylic, enamel, lacquer, urethane, 2-k or other compositions. The top coat is clear but may be flat, semi-flat to high gloss in appearance.

4. Activator, consisting of solvent and resin that is applied to the ink image either prior to being suspended in the water or off the water. The activator accelerates dissolution of the acetate and turns the ink from a solid into a liquid state and improves attachment of the ink to the object or substrate. Application is applied by either an aerosol propellant or a pump actuator device. The activator enhances the chemical bond between the base coat and the applied image.

5. Film, consisting of a layer of ink on an acetate substrate. The film is laid onto a paper base material. The acetate base of the film is water soluble. The film is preprinted and conventionally and commercially available. The film is printed in a variety of colors and patterns, ranging from simple one-color films to complex multicolor camouflage patterns. The film is clear in nature and has printed onto one side a pigmented image of inks. Other abstract designs in the form of wood, carbon fiber, and stone may be printed on the film but the present invention is not limited to these examples.

6. Packaging, consisting of thick cardboard tube and a transparent plastic tube protector with end caps.

7. Full detailed instruction sheet displayed within the transparent clear plastic tube. The clear visual enhancement allows the retail consumer to understand how to use the kit in a retail environment.

BRIEF DESCRIPTION OF THE SEVERAL VIEWS OF THE DRAWINGS

FIGS. 16 through 21 illustrate in detail a preferred kit and packaging according to the present invention.

DETAILED DESCRIPTION OF THE INVENTION

The kit 11 (FIG. 1) of the present invention allows a person with little or no experience to transfer an image from a film onto an object so as to change the overall look or appearance of the object.

Figure 2:
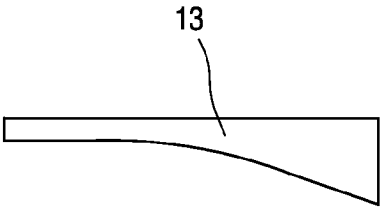
FIG. 2 is a side view of a gun stock object, which is to be processed using the kit of the present invention.

In the embodiment described herein, the object 13 to be imaged is a gunstock (FIG. 2). The object can be any other type of object. Parts of an object can be imaged with the transfer process. For example, with a gun, such as a rifle, the stock is removed from the barrel and firing mechanism so that the stock appearance is changed. The barrel and firing mechanism is not subjected to the transfer process. Those parts will maintain their original appearance. Alternatively, the entire object can be subjected to the transfer process.

The transfer process immerses the object or part in water. The transfer process works well on plastic such as ABS, polypropylene, styrene, PVC and acrylics. Metals such as steel, aluminum and stainless steel may also be used. Even hardwoods such as walnut and oak can be used. Absorbent objects and objects that expand when immersed in water typically do not work well. Such absorbent materials include softwoods, MDF (medium density fiberboard) and plywood. The object must be able to receive a primer or base color coat.

Figure 1:
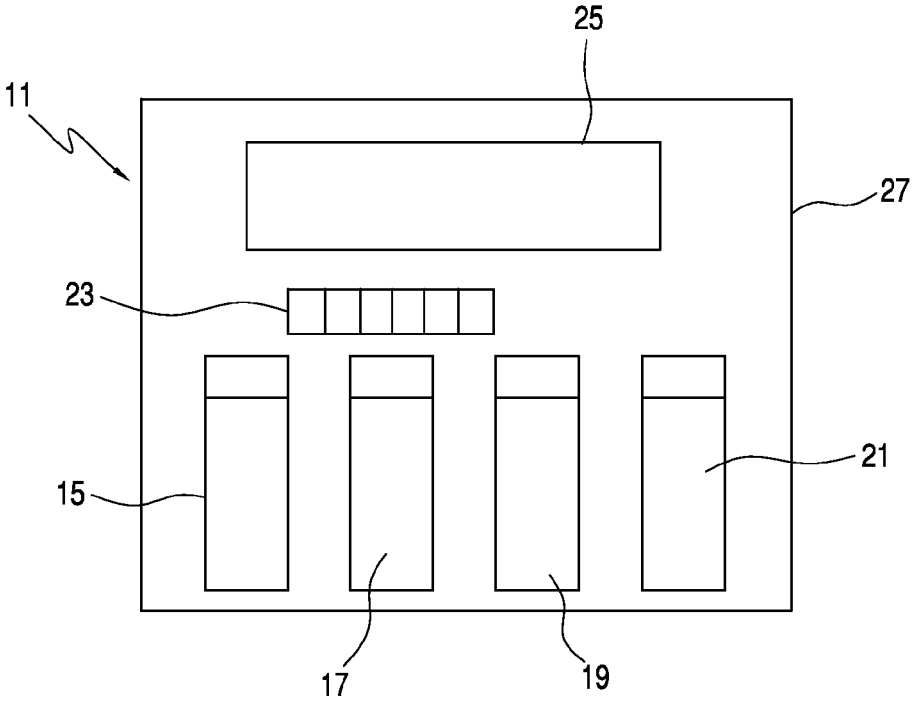
FIG. 1 is a schematic top plan view of the kit of the present invention in accordance with a preferred embodiment.

With reference to FIG. 1, the kit 11 includes an aerosol can of primer paint 15, an aerosol can of base coat paint 17, an aerosol can of activator 19, an aerosol can of clear topcoat paint 21, a temperature sensor 23 and a scuff pad 25. The kit can optionally contain protective equipment for the user, such as a facemask (worn when using the aerosol cans) and a pair of waterproof gloves. A set of instructions (not shown) is also enclosed. The components of the kit are contained in a package 27.

Both the can of primer 15 and can of base coat 17 are acrylic based spray paints. Likewise, the can of topcoat 21 is an acrylic based paint. The topcoat is clear. The topcoat can be polyurethane type paint. The can of activator 19 will be discussed below after a discussion of the film.

Figure 3:
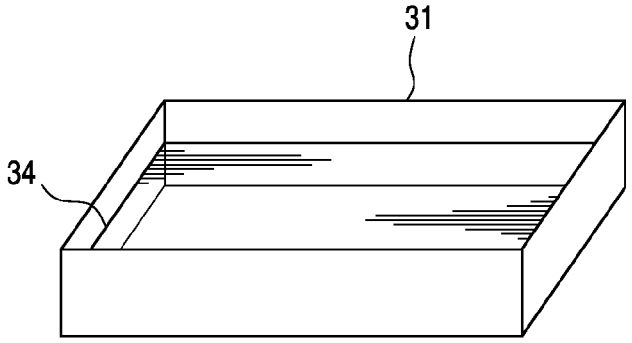
FIG. 3 is a view of a water bath container, which is to be used during the process of the present invention and showing water therein.

The transfer process requires the use of a container 31 (FIG. 3) to hold the water bath for the object 13. Because objects vary in size, and thus the size of the container varies, the kit of the present invention typically does not provide a container. The user selects a container, such as a plastic tub, bucket, etc. Preferably, the container 31 should be square or rectangular in shape so that is easier to use. The container can be made of any material such as plastic, glass, metal, etc. The container 13 should be sized so that when the object is placed inside of the container, there are several inches of space between the object and all sides of the container. The container should be deep enough so that the object can be totally submerged below the water line, without the water lapping or spilling out of the container.

Figure 4:
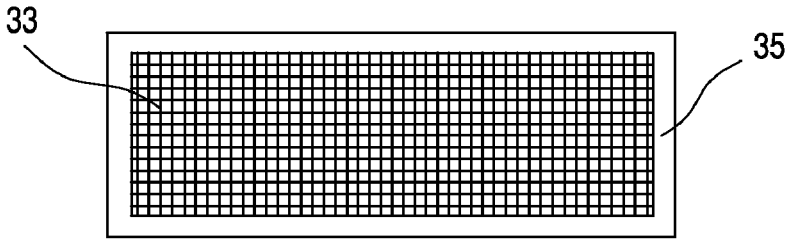
FIG. 4 is a top plan view of the preprinted film on a paper base material that is used in the transfer process of the present invention.

The film 33 (FIG. 4) is preprinted and conventionally and commercially available. The film is printed in a variety of colors and patterns, ranging from simple one-color films to complex multicolored camouflage patterns. The film 33 has a layer of ink on an acetate substrate. The ink is in the pattern and color desired. The film is laid onto a paper base material 35. The acetate base of the film is water-soluble.

The kit 11 may contain one or more pieces of film 33. For example, if the kit is aimed at a hunting market, then camouflage is provided. If the kit is aimed at a young adult or teenage market, then films with bright trendy color can be provided. The film comes in sheets that are rolled up. To use the film, the sheet is unrolled and flattened.

The activator 19 contains a solvent and a resin. The solvent is to accelerate the meltdown of the acetate film. The acetate is water-soluble. Use of the activator 19 accelerates the dissolution of the acetate. In addition, the activator turns the ink into a liquid state and makes the ink better attach or etch into the object. In the preferred embodiment, the activator includes (by weight %):

| | | |
|---|---|---|
| Activator #1) | N-butylacetate | 29.37% |
| | xylene | 29.37% |
| | isophorone | 1.8% |
| | butyl-cellosolze | 26.87% |
| | polyurethane | 12.5% |

In addition, the activator can contain a propellant that is a universal solvent for acrylics.

In other embodiments, other activator mixes can be used. These are (by weight %):

| | | |
|---|---|---|
| Activator #2) | xylene | 50% |
| | isopropanol | 10% |
| | N-butylacetate | 10% |
| | ethylene glycil monomethy ether | 20% |
| | isophorone | 10% |
| Activator #3) | N-butyl acetate | 10% |
| | Xylene | 40% |
| | Isophorone | 10% |
| | Ethylene glycil monomethyl ether | 25% |
| | N-butyl | 5% |
| | Isophorone | 10% |
| Activator #4) | butoxyethoxy-ethanol | 23% |
| | butoxyethoxy-ethyl acetate | 50% |
| | dibutyl phthalate | 27% |

I am the first to package and use an activator in an aerosol can.

The activation of the ink is an important step in the transfer process. Before activation, the ink is solid and will not wrap onto an object or attach to an object. Activation of the ink causes the ink to liquefy so that it wraps onto and attaches or etches to the surfaces of the object. Some activators are more user friendly, or easier to use, than others. For example, activator #1) above, is slower to melt or liquefy the ink, but wraps more easily onto the object. Also, the definition of the ink image remains high when transferred onto the object with activator #1). Activator #4) melts or liquefies the ink easier.

The transfer process for transferring the pattern onto the object will now be described. First, the object 13 or part is prepared. The object is cleaned with a detergent type cleaner. The scuff pad 25 can be used to assist in the cleaning and break the surface of the object. The scuff pad is a conventional and commercially available abrasive pad. The object is then dried. No residue should be on the object and all oil, grease and other contaminants should be removed from the object.

Before using aerosol cans 15, 17, 19, 21 from kit 11, the cans are shaken so as to mix the contents. The can of primer 15 is then used to spray a coat of primer on the object 13. Only the areas that are to receive the ink need be painted. For example, on an object where only the exterior is to be processed, interior surfaces of an object need not be painted with the primer; instead exterior and side or edge surfaces should be primed. The primer is allowed to dry (typically for one hour at room temperature).

Next, the can of base coat 17 is used to spray a coat of paint on the object. The base coat provides a background color to the typically transparent or translucent ink film. For example, if the object is to be given a camouflage pattern, then the base coat can be beige or green to provide the appropriate background color. The base coat is allowed to dry (typically at one hour at room temperature).

Next, the water bath 34 (FIG. 3) is prepared. The container 31 is filled with enough water to allow the object 13 to be fully submerged. The surface of the water should be below the top rim of the container (typically one inch below the top). The water is between 70-80 degrees F. If need be, the water can be heated or cooled to obtain the proper temperature. The temperature sensor 23 is used to determine the water temperature. The temperature should hold during the entire processing time (typically for half an hour).

The film 33 is then prepared. The film 33 has a label that says this side up. The film is maintained in this orientation when transferred to the water bath in the container. While preparing the film before it is immersed into the water, the film should stay dry. Frequently, the sheet of film is much larger than the object. Therefore, only as much film as is needed is used. The appropriate amount of film is cut from the sheet; the film is sized so as to completely cover the surfaces that are to be processed. Also, the ink image will expand when on the surface of the water in the container to the sides of the container. The film should be cut to minimize its expansion to one inch or so. If the expansion is three to four inches or more, then the image may expand so much as to lose definition on the object.

Figure 5:
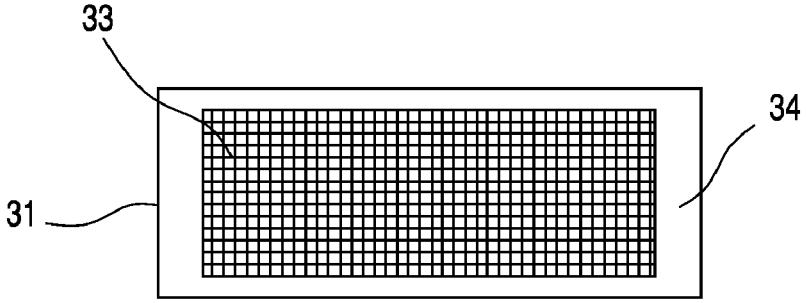
FIG. 5 is a top view of the container shown in FIG. 3 with the film floating on the surface of water therein.

The film 33 is removed from its paper base 35. For example, one corner of the film is gently peeled from the base. The film is held by two opposite corners and laid onto the surface of the water. The film should be bowed so as to sag between the two corners that are being held. The center of the film sags and contacts the water while the film is then rolled on top of the water. This minimizes entrapment of air bubbles by the film. The film is allowed to sit on the water or hydrate for 60 seconds (FIG. 5). Then, the film 33 is sprayed with the activator 19. The activator is sprayed on to all of the areas of the film. If need be, overlapping patterns of spray are used.

Figure 6:
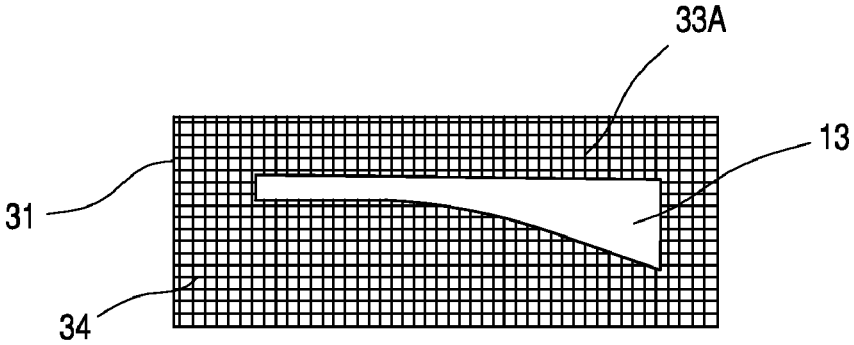
FIG. 6 is a top view of the container showing the gun stock object being placed onto the expanded film in the container.

The user waits 15 to 20 seconds as the activator works on the film, turning the ink pattern into liquid ink as the acetate base dissolves. As shown by FIG. 6, the ink 33A now liquefied, expands to the sides of the container 31 so as to completely cover the surface of the water 34.

The object 13 is then placed on top of the ink (see FIG. 6) and then pushed down to become submerged in the water. In order to avoid air bubbles between the ink and the object, the object is tilted and immersed first at one end, then the intermediate portions immersed, followed by the opposite end until the entire object is completely submerged. The ink 33A attaches to the object and even wraps onto the side surfaces or edges. For example, with the gunstock object shown, the ink completely envelopes the stock. The ink attaches or etches into the object so as to provide a firm bond.

Figure 7:
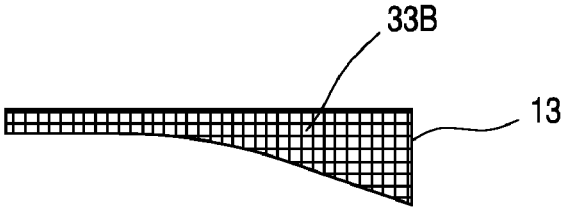
FIG. 7 is a view of the object after the transfer process has been completed.

Once the ink has contacted all desired surfaces of the object, the object 13 is removed from the water bath (see FIG. 7) with care to avoid touching or contacting the inked surfaces. The ink pattern 33B is now on the object. Because the ink has attached or etched onto the object surface, it is difficult to remove. Nevertheless, a protective coating is typically applied to minimize nicks and scratches to the image. The object is then rinsed with water to remove any PVA residue. Warm or hot water works better than cold water to remove the residue. All residues should be removed in order to allow the top coat to adhere to the object. After rinsing, the object air dries. Shiny areas on the object indicate the presence of residue; the object should be re-rinsed until the shiny areas are gone.

When the object is dry, the can of top coat 21 is used to spray a clear coat on to the inked surfaces of the object. Several top coats are typically applied with the previous coat being allowed to set up for 10 to 15 minutes at room temperature before spraying the next coat. The top coat provides a protective coating over the ink. The object is now ready for reassembly and use.

Thus, a user can transfer an image onto an object without the need for costly equipment or a controlled environment, as with conventional and commercial water transfer printing process operations.

One feature of the present invention is the step of applying a primer coat spray paint to any object formed from plastic, metal, wood and glass, but not limited to these substrates. An aerosol propellant or a pump actuator device is used to evenly apply the primer coat paint of acrylic, enamel, lacquerer, urethane, 2-K or other water borne primer coating to the desired object. This step process improves the surface of the substrate on which the image will be transferred. The primer is only applied to the areas of the object where the image will be formed. The primer coat is then dried.

The second feature of the invention is to provide a method of applying a base coating material over the dried primer coating material. The base coating is applied using an aerosol propellant or a pump actuator device to evenly coat an acrylic, enamel, lacquerer, urethane, 2-K or other base coating material onto the dried primer. The base coating material bonds to the primer coating material. The pigmented color of the base coating material determines the hue or color base of an image prior to the ink transfer step. The base coating material can and does consist of any and all colors within the spectrum of colors. Once activated, the base coating material will soften and allow the ink pigmented image to transfer into the base coating material to impregnate it and assure attachment of the image to the substrate.

A third feature of the present invention is to provide a method of applying an activator, which contains a solvent and a resin, to a pigmented ink image on the film via an aerosol propellant or other hand held pump actuator device so that the activator may be evenly applied. In one embodiment of the present invention the activator consist of the following materials (by weight %): 2% Modified Chlorinated Polypropylene and 98% Toluene; or 29.37% N-Butyl Acetate, 29.37% Xylene, 1.89% Isophorone, 26.87% Butyl-Cellosolve and 12.50% Polyurethane; or 50% Xylene, 10% Isoprpanol, 10% N-Butyl Acetate, 20% Ethylene Glycil Monomethyl Either and 10% Isophorone.

When the activator according to the present invention method is applied to the pigmented inks of the pre-printed film, it causes a chemical reaction that changes the ink from a solid to a liquid state. The resin content of the activator assists in supporting the inks when it is in a suspended state during the water bath step of the present invention. The resin content of the activator also enables the ink, when in the liquid state, to wrap around the three dimensional object being image transferred. The activator also softens the base coating material on the object and enables the ink to impregnate the base coating forming good adhesion of the image to the object.

A fourth feature of the invention is to provide a method step of suspending the ink image within a water bath so that it can be transferred to an object. The image can consist of any design, including but not limited to, wood, carbon fiber, and stone. The film is a clear acetate base sheet onto which a desired ink image has been printed. Such films are conventionally and commercially available and generally consist of a standard polyvinyl acetate (PVA) water soluble component. The film is clear in nature with an image applied or printed onto on side of the surface using pigmented inks. The film is laid in a water bath having a desired temperature with the ink or printed side up. The water temperature should be between 28 and 38 Celsius. The film should lie in the water bath for approximately sixty seconds. After sixty seconds, an activator is sprayed onto the film in an even application using either an aerosol propellant or a pump actuator device. The suspended film hydrates and dissolves the PVA substrate by about 80%. The ink rejuvenates and returns to liquid form and is suspended within the top surface of the water bath by the residue PVA film. The pretreated object to be processed is then submersed into the liquefied inks. The object must be submersed completely through the liquefied inks into the vat of liquid. The activator softens the base coating which permits the inks to impregnate the base coating and become unitary. The pressure of the submersion of the object into the liquid vat secures transfer of the image onto the object.

A fifth feature of the method according to the present invention is to apply one or more coatings of clear coat material over the object which has now been image transferred by using a aerosol propellant or a pump actuator device. The top coat is a protective clear coating of acrylic, enamel, lacquerer, urethane or other water borne coating material. The coating may be flat, semi-flat or high gloss. The clear coat is encapsulates the image on the object and protects it against scratches or the like.

The method of applying an image onto an object, using the kit of the present invention, is illustrated in greater detail with reference to FIGS. 8 through 15.

Figure 8:
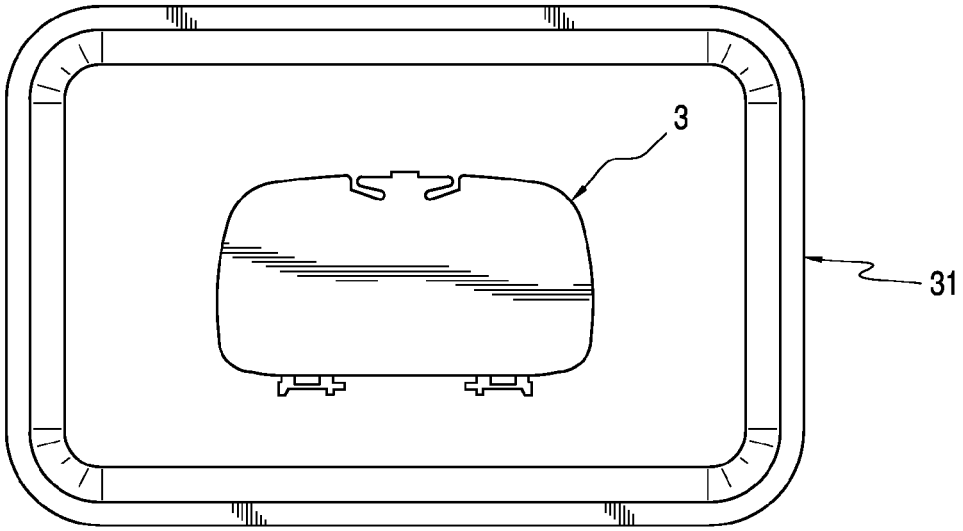
FIGS. 8 through 15 illustrate in greater detail the method steps when using a kit according to the present invention.

Referring to FIG. 8, a container or vat 31 appropriately sized for use in the present process is shown. The container 31 can be constructed of metal, glass, plastic or any type of substrate adapted to hold liquid. The container will hold the water necessary for the transfer possess step. The container is usually sized so that the object to be imaged will have at least one inch distance from any one side of the container when it is immersed therein. This allows the ink pigmented film sufficient room to expand following application of the activator. An object 3 to be image transferred is shown within the properly sized container 31.

Figure 9:
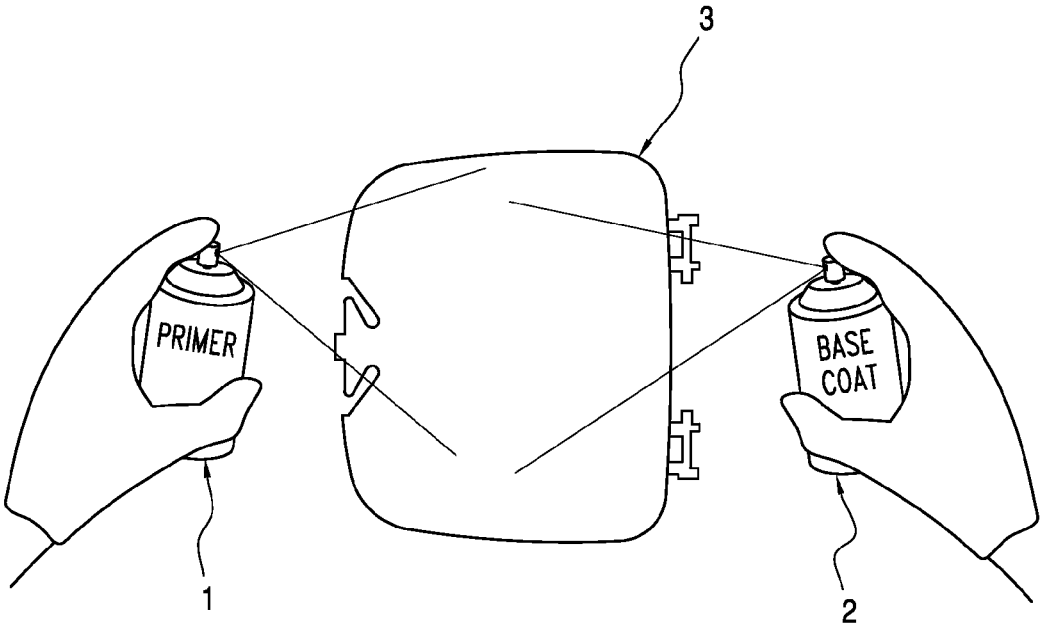

Referring to FIG. 9, application of the primer coating 1 and base coating 2 using an aerosol propellant or a pump actuator device is illustrated. As noted earlier, the primer coat is applied to those areas of the object on which the ink will be transferred. After drying, a base coating is sprayed on the object to provide background color for the ink image after it is transferred onto the object.

Figure 10:
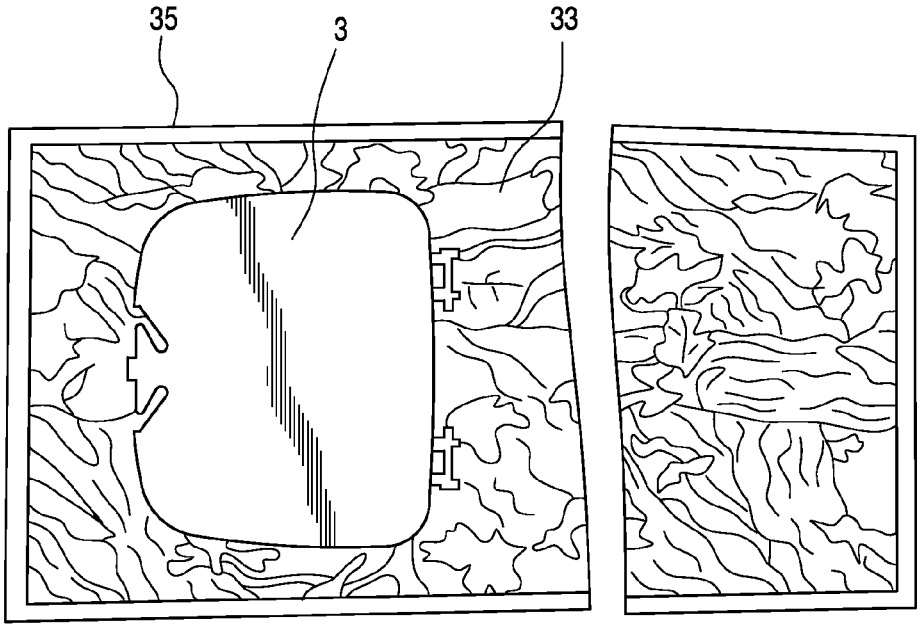

Referring to FIG. 10, the unrolled film 33 is shown with the object 3 to be imaged positioned on top of the film. The film is provided with a label indicating which side should face up when it is placed within the water bath. The film is trimmed with scissors (not shown) since it is typically larger than the object to be imaged. The appropriate amount of film is cut from the sheet; the cut film being sized so as to completely cover the surfaces of the object to be imaged. Since the image will expand during immersion within the water bath, the film is cut to minimize expansion to no more than about an inch or so. If the film expands more than about three or four inches, the image could lose definition once applied to the object.

Figure 11:
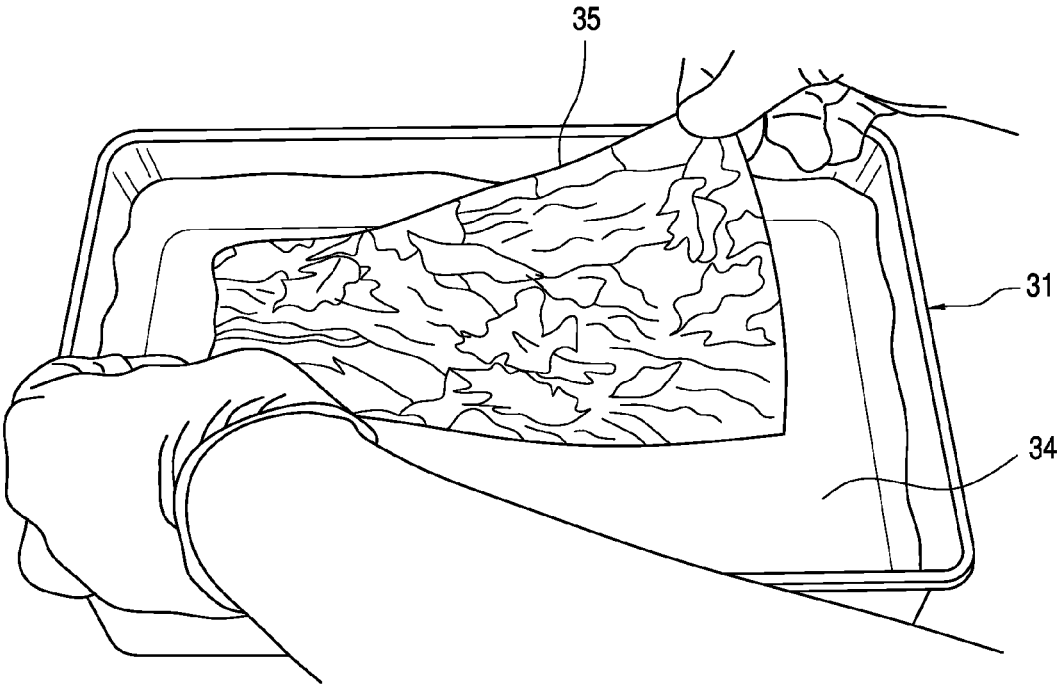

FIG. 11 illustrates placement of the cut film 35 within a water bath 34. Container 31 is filled with water having a depth sufficient to allow the object being imaged (not shown) to be submerged. The surface of the water is below the top of the container. The water temperature is kept between about 70-80 F during the entire process, the temperature sensor 23 provided with the film (no shown) may be used to monitor water temperature. The cut film is then separated from the paper base material 35 and laid onto the water in the container beginning at one end and continuing to the other end. The cut film is placed in the bath gently so as to not trap air bubbles between the film and the water. The film is maintained in the water bath for about sixty seconds to sufficiently hydrate the film.

Figure 12:
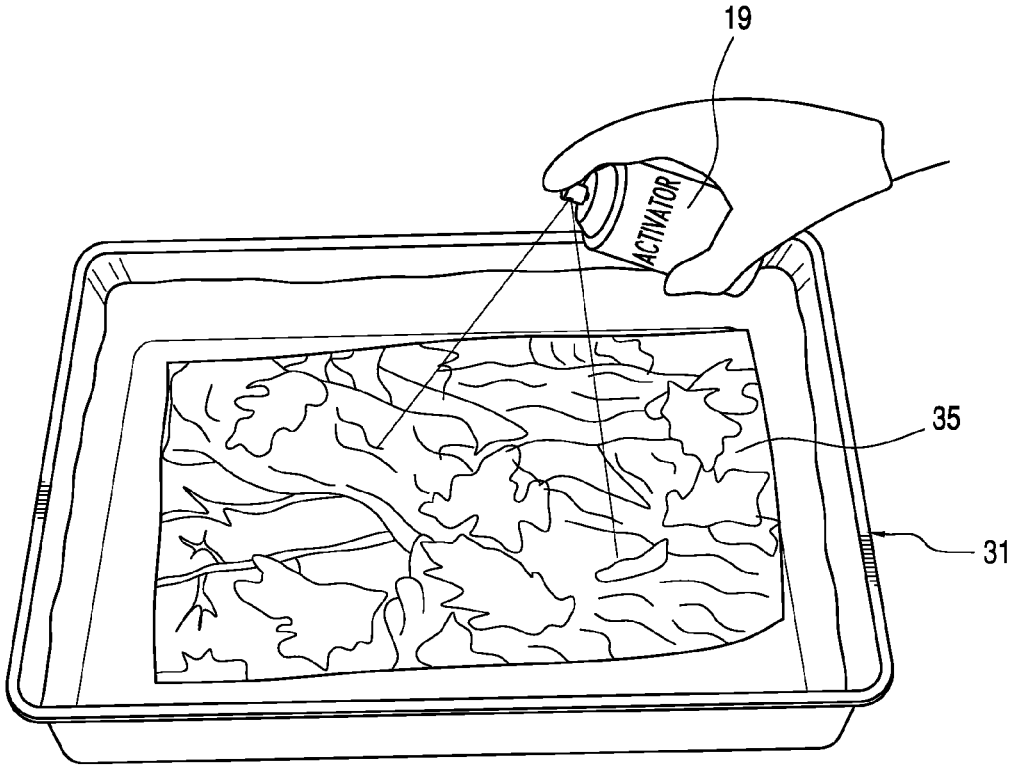

FIG. 12 illustrates application of the aerosol or pump sprayed activator 19 to the hydrated film 35. The activator is sprayed on all areas of the film using a back and forth motion that overlaps the activator as it is applied. Within a few seconds the film will begin the expand indicating the ink is now in a liquid state.

Figure 13:
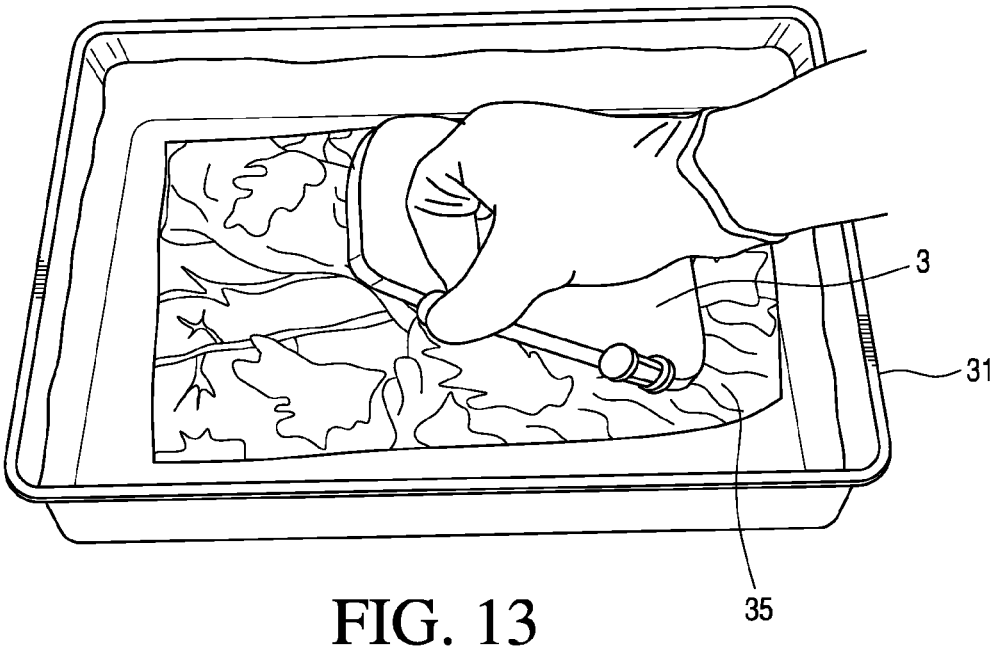

FIG. 13 illustrates the object 3 being placed on the activated ink which is now in liquid form and suspended on the top surface of the bath water. The object is submersed into the water bath beginning at one end while applying even pressure and maintaining the object at a thirty to forty degree angle. The object is completely submersed into the water bath at the same angle throughout which eliminates air from being trapped between the liquefied ink and the object being imaged. After the object is completely coated by the ink, it is carefully removed from the water bath taking care to minimize touching or contacting the now ink applied surfaces.

Figure 14:
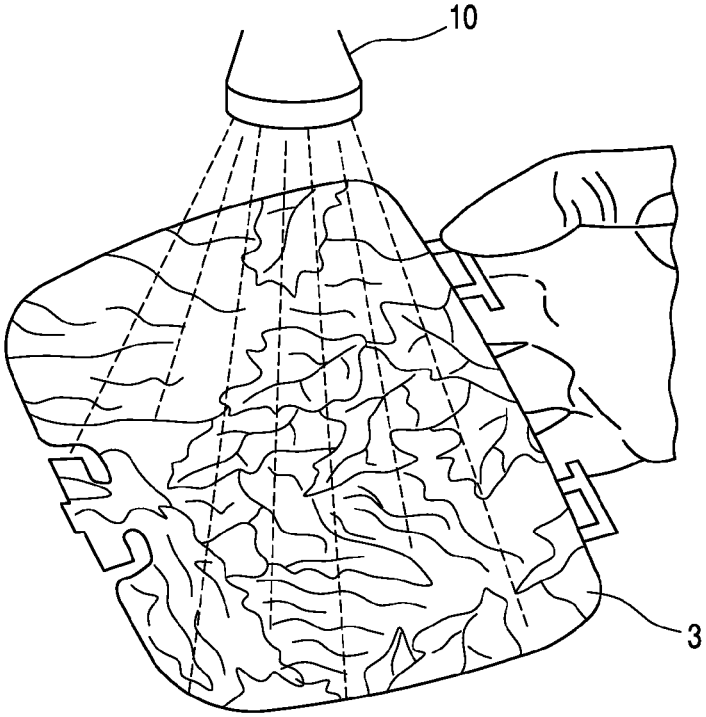

FIG. 14 illustrates the rinsing step for removing any film membrane left on the object following the previous step. The now imaged object 3 is gently rinsed under warm running water 10 to remove any residue from the previous process step. The image has now been fully transferred to the object.

Figure 15:
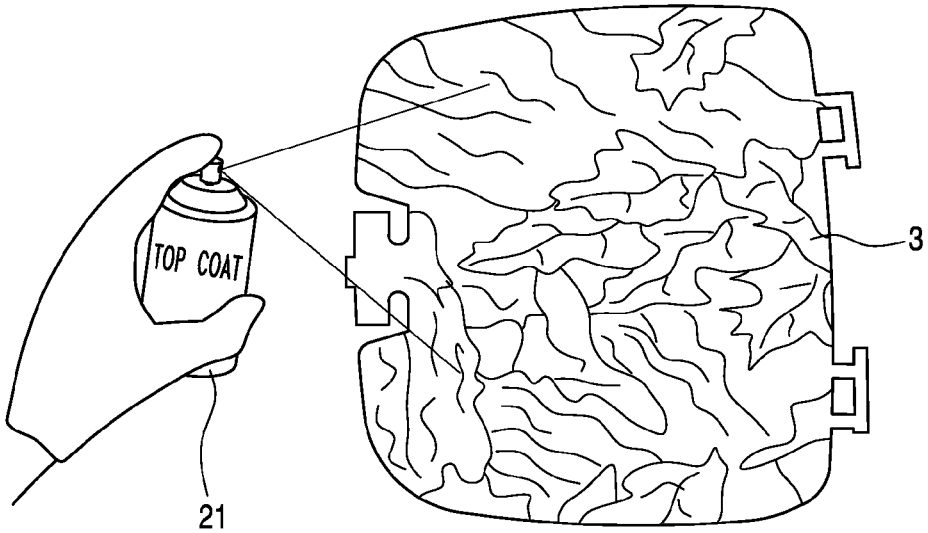
Figure 16:
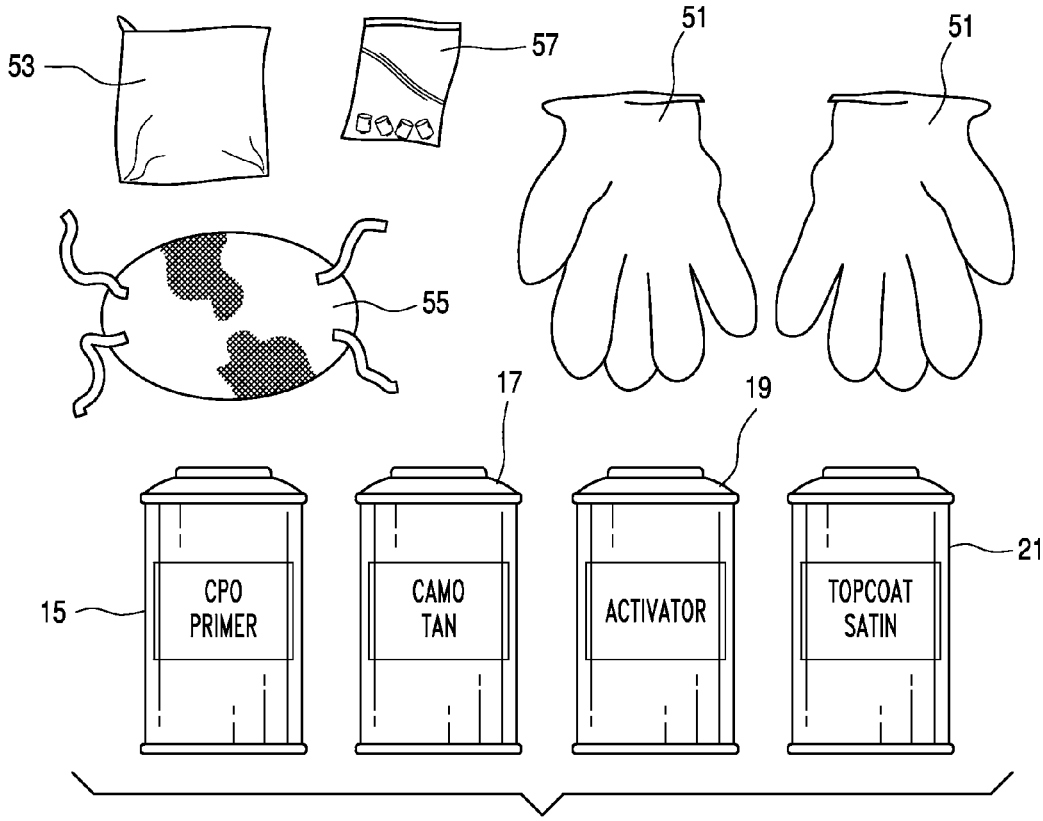

Referring to FIG. 15, application of the clear top coat is shown. The clear top coat is a protective coating to minimize nicks and scratches to the now applied image. The top coating material is applied using an aerosol propellant or a pump spray device. It is applied evenly and allowed to dry after which additional coats may be applied.

The packaging of the kit will now be described with reference to FIGS. 16 through 21.

Figure 17:
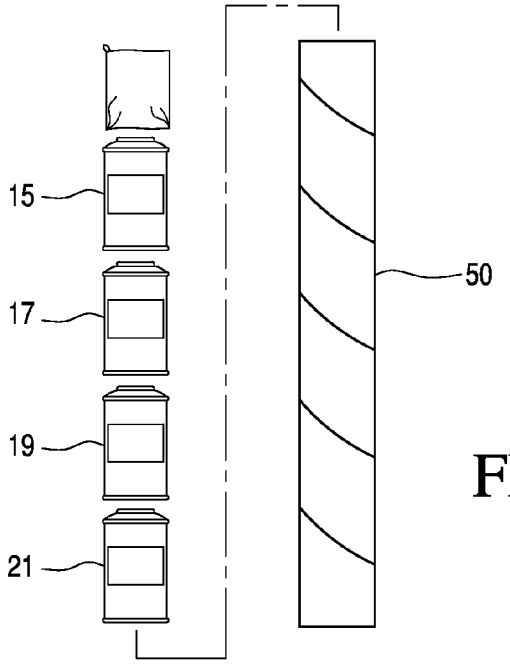

A thick cardboard tube 50 is the kit container. As best shown in FIG. 17, the individual aerosol propellant canisters or containers utilizing pump actuator devices 15, 17, 19 and 21 are readily inserted within the cardboard tube 50. The cardboard tube 50 also provides rigidity and durability to the packaging. The supporting kit components (FIG. 16) such as the gloves 51, scuff pad 53, respirator mask 55, spray can nozzles 57 and temperature sensor 23 (not shown) are likewise placed within the remaining open portions of the cardboard tube 50. As is apparent, it is within the scope of the invention to not include all of these items. For example, if the end user has a water thermometer, the temperature sensor need not be packaged within the kit. However, in a preferred embodiment, all components required to transfer the image to an object are provided within the kit so that a consumer need not purchase any other items prior to using the kit.

The water soluble film 33 with paper backing 35 is wrapped around the outside of the cardboard tube 50 as shown in FIG. 18. This allows the film to stay stable for display and shipping prior to use. A paper sheet 59 is then wrapped around the film to protect it. Preferably, the paper sheet 59 has detailed operating instruction on the inside surface to assist a consumer in using the kit to transfer an image to an object. The outer surface of the paper sheet 61 (FIG. 19) may be used for advertising purposes i.e. to show examples objects being processed.

Once all the components of the kit are placed within the cardboard tube 50 and all supporting documentation 59 are wrapped on the outside of the cardboard tube 50, the unit is sealed within a PVC shrink wrap film 70 to protect the tube and its contents as best shown in FIG. 19. Other protective film is within the scope of the present invention. The water soluble film 33 within the kit is moisture sensitive and needs to be protected from the elements. The PVC film 70 is heated as best shown in FIG. 20 to shrink the film and create a moisture secured environment for the film and supporting components of the kit prior to its use.

The cardboard tube consisting of all of the elements of the kit which has been shrunk wrapped is then placed within a clear plastic tube 72 as best shown in FIG. 21. The clear tube 72 is permanently sealed at one end and a cap is applied at the other end once the kit components are placed within the clear plastic tube 72. The cap on the clear tube is then sealed with a PVC shrink-wrap seal tape. The clear plastic tube protects the kit from any damage that may result from moisture, dirt or transporting misconduct. The clear plastic tube 72 performs a visual display tool for the retailer and for the retail consumer. It allows the retail consumer to view the self contained kit without the need of opening the package prior to the purchase. The compact size of the package makes the kit retailer and consumer friendly, less costly to ship by courier to retail customers and requires less retail space when displayed in a retail outlet.

While this invention has been described as having a preferred design, it is capable of further modifications, and uses and/or adaptations following in general the principle of the invention and including such departures from the present disclosure as come within the known or customary practice in the art to which the invention pertains, and as may be applied to the central features hereinbefore set forth and within the scope of the invention.

I claim:

1. A kit for transferring an image onto an object, the kit comprising at least:

a) an aerosol or pump spray can of primer paint;

b) an aerosol or pump spray can of base coat paint having a desired color;

c) an aerosol or pump spray can of an ink image activator;

d) an aerosol or pump spray can of a clear coat material;

e) a sheet of film having a desired printed image thereon, the film is releasably secured to a flexible base sheet material;

f) a temperature sensor;

g) an elongated container tube container having a diameter sufficient to receive an aerosol or pump spray can;

h) an indicia sheet having a length and width about the same size as the sheet of film;

i) a length of shrink wrap plastic; and j) a clear plastic tube adapted to receive the container tube therein wherein said kit when in an assembled position will receive said aerosol or pump spray cans of primer paint, base coat paint, ink image activator and clear coat paint within the container tube while in a stacked relation and including the temperature sensor, the film sheet and the indicia sheet are simultaneously wrapped around the exterior of the container tube so that indicia faces outward, the shrink wrap film is wrapped around the film and indicia sheets to protect the same and the shrink wrapped container is received and sealed within the clear plastic tube to secure the same.

2. A kit for transferring an image onto an object as in claim 1 and wherein the image on the indicia sheet is a camouflage pattern.

3. A kit for transferring an image onto an object as in claim 1 and wherein said primer paint is selected from the group consisting of acrylics, enamels, lacquers, urethanes, and 2-K.

4. A kit for transferring an image onto an object as in claim 1 and wherein said base coat paint is selected from the group consisting of acrylics, enamels, lacquers, urethanes, and 2-K.

5. A kit for transferring an image onto an object as in claim 1 and wherein said top coat paint is clear and is selected from the group consisting of acrylics, enamels, lacquers, urethanes, and 2-K.

6. A kit for transferring an image onto an object as in claim 1 and wherein said film comprises an ink printed on a clear polyvinyl acetate film sheet.

7. A kit for transferring an image onto an object as in claim 1 and further comprising a pair of waterproof gloves, respirator mask and scuff pad.

8. A kit for transferring an image onto an object as in claim 1 and wherein the ink image activator comprises by weight % N-butylacetate 29.37%, xylene 29.37%, isophorone 1.8%, butyl-cellosolve 26.87% and polyurethane 12.5%.

9. A kit for transferring an image onto an object as in claim 1 and wherein the ink image activator comprises by weight % N-butylacetate 10%, xylene 50%, isopropanol 10%, ethylene glycil monomethyl ether 20% and isophorone 10%.

10. A kit for transferring an image onto an object as in claim 1 and wherein the ink image activator comprises by weight % N-butylacetate 10%, xylene 40%, isopropanol 10%, ethylene glycil monomethyl ether 25%, isophorone 10% and N-butyl 5%.

11. A kit for transferring an image onto an object as in claim 1 and wherein the ink image activator comprises by weight % butoxyethoxy-ethanol 23%, butoxyethoxy-ethyl acetate 50%, and dibutyl phthalate 27%.

12. A kit for transferring an image onto an object as in claim 1 and wherein said base coat paint has a color.

13. A kit for transferring an image onto an object as in claim 1 and wherein the ink image activator comprises by weight %, 2% Modified Chlorinated Polypropylene and 98% Toluene.

14. A kit for transferring an image onto an object as in claim 1 and wherein the image on the indicia sheet is a wood grain pattern.

* * * * *